United States Patent [19]

Hunyadi et al.

[11] 4,174,608

[45] Nov. 20, 1979

[54] COMBUSTION CHAMBER FOR A GAS TURBINE

[75] Inventors: Laszlo Hunyadi, Järfälla; Leif Anderson; Martin Månsson, both of Finspång, all of Sweden

[73] Assignee: Stal-Laval Turbin AB, Finspong, Sweden

[21] Appl. No.: 766,570

[22] Filed: Feb. 7, 1977

Related U.S. Application Data

[63] Continuation of Ser. No. 613,580, Sep. 15, 1975, abandoned, and a continuation of Ser. No. 386,288, Aug. 6, 1973, abandoned.

[30] Foreign Application Priority Data

Aug. 15, 1972 [SE] Sweden ..... 10548/72

[51] Int. Cl.[2] ..... F02C 7/22

[52] U.S. Cl. ..... 60/39.65

[58] Field of Search ..... 60/39.65, 39.66; 431/351, 352

[56] References Cited

U.S. PATENT DOCUMENTS

| | | | |
|---|---|---|---|
| 2,654,219 | 10/1953 | Zaba | 60/39.65 |
| 2,919,549 | 1/1960 | Haworth et al. | 60/39.65 |
| 3,570,241 | 3/1971 | Alexander | 60/39.65 |
| 3,594,109 | 7/1971 | Penny | 60/39.65 |
| 3,702,058 | 11/1972 | De Corso et al. | 60/39.65 |
| 3,777,484 | 12/1973 | Dibelius et al. | 60/39.65 |
| 3,899,876 | 8/1975 | Williamson | 60/39.65 |
| 3,918,255 | 11/1975 | Holden | 60/39.65 |

FOREIGN PATENT DOCUMENTS

| | | | |
|---|---|---|---|
| 200964 | 12/1968 | U.S.S.R. | 60/39.65 |

*Primary Examiner*—Robert E. Garrett
*Attorney, Agent, or Firm*—Eric Y. Munson

[57] ABSTRACT

Combustion system for gas turbines and the like, comprising an outer shell connected to a source of pressurized air and surrounding a flame tube which comprises a combustion chamber and a mixing chamber defined within a double wall construction comprising an outer wall and an inner wall forming an annular cooling jacket axially surrounding the mixing chamber. A portion of the pressurized air is directed radially into the mixing chamber through a plurality of nozzles which are spaced about the cooling jacket, while another portion of the air is passed into said annular jacket through apertures in the outer wall alternating with and spaced a distance from said nozzles to produce a plurality of diverging high velocity peripheral streams which sweep and cool the walls of the jacket preliminary to being passed into the mixing chamber through apertures in the inner wall which are aligned with said nozzles.

2 Claims, 3 Drawing Figures

COMBUSTION CHAMBER FOR A GAS TURBINE

This is a continuation, of application Ser. No. 613,580 filed Sept. 15, 1975, now abandoned; a continuation of Ser. No. 386,288, Aug. 6, 1973, now abandoned.

BACKGROUND OF THE INVENTION

The present invention relates to a gas turbine combustion chamber of substantially cylindrical shape. Such a combustion chamber may be divided into two zones in the axial direction, namely the primary zone, in which the combustion takes place, and the mixing zone, in which the hot combustion gas from the primary zone is mixed with diluting air in order to achieve the proper temperature of the gas which is supplied to the turbine.

Such a combustion chamber consists, among other things, of an outer shell which absorbs the gas pressure which is determined by the working pressure of the turbine.

Inside the shell is the flame tube with its own cylindrical wall and being divided into two zones, namely the primary or combustion zone in which the proper combustion takes place, and the mixing zone in which the hot combustion gases are mixed with diluting air so as to achieve a suitable temperature of the mixing gas before this is supplied to the turbine.

SUMMARY OF THE INVENTION

The present invention relates to a means in such a flame tube for cooling the wall of the mixing zone with a portion of the diluting air, the main portion of which is supplied to the mixing zone through special nozzles. According to the invention, the wall of the mixing zone is shaped as a double wall with particular apertures in the inner and outer walls displaced with respect to each other so that a portion of the diluting air passes in peripheral direction between these two walls and cools it. The combustion chamber is constructed according to the accompanying claims.

BRIEF DESCRIPTION OF THE DRAWINGS

FIG. 1 shows a longitudinal section through the combustion chamber whereas;

DESCRIPTION OF A SPECIFIC EMBODIMENT

Figure 1:
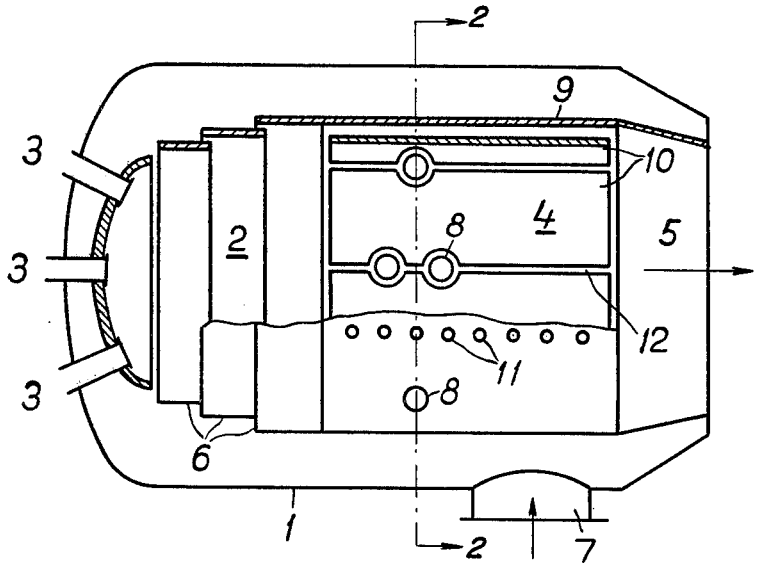

The combustion chamber consists of an outer shell 1, inside which the actual flame tube is positioned and which is divided into a combustion zone 2 and a mixing zone 4, in which the hot combustion gases are mixed with diluting air for the purpose of acquiring a suitable temperature before the mixed gas is passed to the gas turbine through the dischare opening 5. The flame tube in FIG. 1 is shown partly in a section and partly in elevation seen from the outside.

At the left-hand end of the flame tube are the burner nozzles 3 through which the fuel—liquid or gaseous—together with primary combustion air is injected into the combustion zone 2. The latter comprises a number of adjoining overlapping coaxial rings 6 having successively with some increasing diameters and which jointly form the combustion zone.

The air from a conventional turbine compressor or an air storage chamber is introduced through the inlet 7 adjacent the discharge end 5 of the combustion chamber and is passed along the exterior of the flame tube to the gaps between the rings 6, where it is introduced into the combustion zone as secondary combustion air.

Another substantial portion of the compressor air passes through the nozzles 8 as diluting air into the mixing chamber 4. The nozzles 8 may be designed and positioned according to co-pending U.S. Pat. application 197,345, filed Nov. 10, 1971, now abandoned, and refiled as continuation application Ser. No. 401,440, now U.S. Pat. No. 3,874,169.

Figure 2:
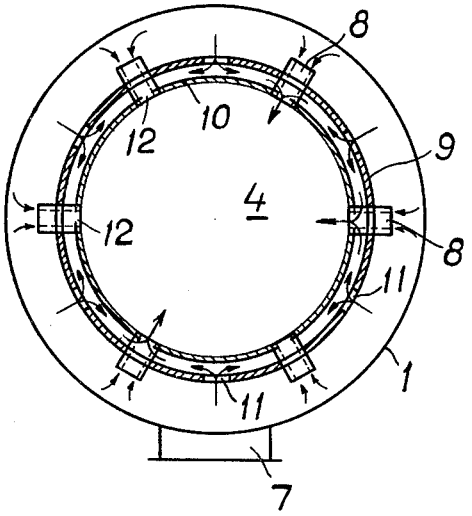
FIG. 2 shows a cross section through the combustion chamber.

The mixing chamber 4 comprises a double wall, as will be clear from FIG. 2 which is a cross section taken along the line 2—2 of the mixing chamber. The chamber comprises an outer wall 9, at the inside of which screen plates 10 are arranged at a relatively small distance from the outer wall, forming an inner wall.

A portion of the air from the inlet 7 passes through apertures 11 in the outer wall 9 and is sub-divided into a plurality of peripheral streams which flow with high velocity to gaps or apertures 12 in the screen plates 10, said gaps or apertures 11 by which the flow of said peripheral streams at high velocity is caused. In this manner, the outer wall 9 as well as the screen plates 10 because of the high velocity air streams between the walls, are efficiently cooled.

Figure 3:
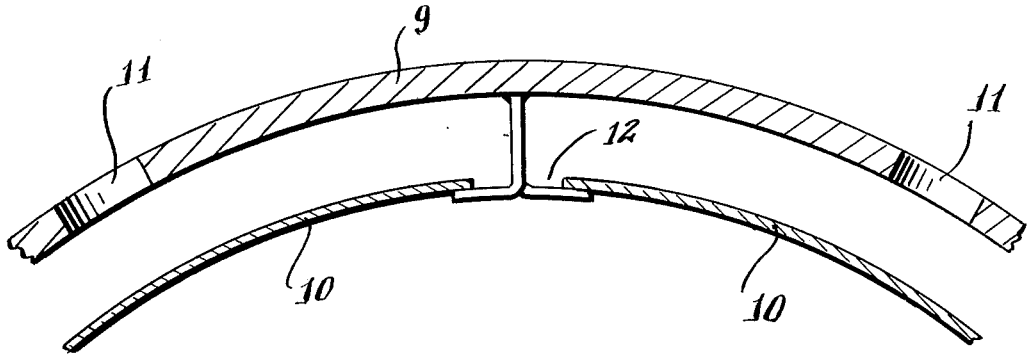
FIG. 3 is a fractional sectional view showing the double-walled structure of the mmxing zone and how the inner wall is supported by the outer wall.

The outer wall 9 forms a support for the flame tube and should therefore be made sufficiently strong, and an efficient cooling of this wall must be secured. As shown in FIG. 3, the inner wall is supported by the outer wall by fingers 11 which are connected to the outer wall 9. This cooling is achieved due to the fact that the screen plates 10 and the cooling air flowing in the space between the outer wall 9 and the screen plates prevent the outer wall from being subjected to radiation heat and conduction heat. The screen plates 10, which have no supporting function but may themselves be supported by the outer wall, are suitably made from a rather thin metal sheet of a heat resistant material, thus acquiring a substantial durability under influenced by proper cooling conditions. The relative thinness of the inner wall uses the high cooling capacity of the peripheral air streams in the most efficient manner.

In FIG. 1 the screen plates 10 are shown as cylindrical segments with axially extending gaps therebetween. However, it is also possible to make a continuous inner wall with rows of apertures instead of the axial gaps. Like the gaps 12, the apertures are suitably placed halfway between the apertures 11 in the outer wall 9.

We claim:

1. A combustion system for turbines and the like, comprising:

(a) a flame tube having means (3) for admitting a mixture of fuel and primary combustion air;

(b) a shell (1) surrounding said flame tube and defining an annular air space surrounding said flame tube;

(c) said flame tube comprising a combustion chamber (2) and a mixing chamber (4) in which the hot gases passed from the combustion chamber are mixed with diluting air;

(d) said mixing chamber (4) being defined within a double wall construction comprising a relatively thick outer wall (9) supporting said flame tube within said shell and a relatively thin inner wall (10) of heat resistant material, which is supported by the outer wall and which forms a coaxial annular cooling jacket surrounding said mixing chamber;

(e) conduit means (7) for passing pressurized air into said annular air space;

(f) a plurality of cooling apertures (11) spaced about the periphery of said outer wall for admitting a portion of said pressurized air into said cooling jacket;

(g) a plurality of nozzle means (8) spaced alternately with said cooling apertures about the periphery of said cooling jacket for directing a diluting stream of said pressurized air radially into said mixing chamber;

(h) said inner wall having diluting apertures (12) aligned with said nozzle means;

(i) the spacing between said cooling apertures (11) and said diluting apertures (12) being effective to produce high velocity air streams diverging in opposite directions within said jacket from said cooling apertures (11) to said diluting apertures (12) to cool said outer and inner walls (9, 10) preliminary to their injection into said mixing chamber along with said diluting stream.

2. A combustion system according to claim 1, in which a plurality of overlapping annular tubular members defining intermediate gaps extend coaxially from the mixing chamber and into which gaps a portion of said pressurized air is passed to provide secondary combustion air.

* * * * *